United States Patent [19]

Stavros

[11] 4,421,054

[45] Dec. 20, 1983

[54] APPARATUS FOR PREVENTING SURFACE BLEMISHES ON ALUMINUM-ZINC ALLOY COATINGS

[75] Inventor: Anthony J. Stavros, Bethlehem, Pa.

[73] Assignee: Bethlehem Steel Corporation, Bethlehem, Pa.

[21] Appl. No.: 310,596

[22] Filed: Oct. 13, 1981

Related U.S. Application Data

[62] Division of Ser. No. 139,607, Apr. 11, 1980, Pat. No. 4,310,572.

[51] Int. Cl.[3] ..... B05C 11/06

[52] U.S. Cl. ..... 118/63; 118/420; 118/422; 118/65

[58] Field of Search ..... 118/63, 125, 422, 68, 118/65, 420; 15/306 A; 427/349, 367, 432, 433

[56] References Cited

U.S. PATENT DOCUMENTS

| | | | |
|---|---|---|---|
| 2,166,251 | 7/1939 | Herman | 118/65 X |
| 2,197,622 | 4/1940 | Sendzimir | 427/320 |
| 2,526,731 | 10/1950 | Coburn | 427/432 |
| 3,270,364 | 9/1966 | Steele | 118/63 |
| 3,295,960 | 1/1967 | Parlee et al. | 75/93 |
| 3,632,411 | 1/1972 | Stark | 427/432 |
| 3,685,986 | 8/1972 | Rutes et al. | 75/96 |
| 3,707,400 | 12/1972 | Harvey et al. | 421/349 |
| 3,738,861 | 6/1973 | Sciffer et al. | 427/367 |
| 3,754,897 | 8/1973 | Derham et al. | 75/96 |
| 3,964,916 | 6/1976 | Armistead et al. | 106/38.27 |
| 3,976,474 | 8/1976 | Wunder et al. | 75/96 |
| 4,033,762 | 7/1977 | Sato | 75/96 |
| 4,107,357 | 8/1978 | Asakawa et al. | 427/300 |

FOREIGN PATENT DOCUMENTS

| | | |
|---|---|---|
| 52-80233 | of 0000 | Japan . |
| 1403235 | of 0000 | United Kingdom . |

*Primary Examiner*—John P. McIntosh
*Assistant Examiner*—Mary Beth Fennell
*Attorney, Agent, or Firm*—John I. Iverson; William B. Noll; John J. Selko

[57] ABSTRACT

The occurrence of defects on wire coated with an aluminum-zinc alloy coating applied by hot dipping in a molten coating bath is substantially decreased by preventing the deposition of zinc powder particles upon the surface of the molten aluminum-zinc coating prior to solidification of the coating. The deposition of metallic zinc powder particles upon the molten aluminum-zinc coating may be alleviated in several different manners, including preventing the formation of the zinc powder, preventing the accumulation of the zinc powder upon the surface of the molten aluminum-zinc bath, decomposing the zinc powder before it accumulates and exhausting or removing the zinc powder from the vicinity of the molten metal coated wire as it leaves the molten bath. Several novel apparatus arrangements for accomplishing the above are disclosed.

14 Claims, 12 Drawing Figures

APPARATUS FOR PREVENTING SURFACE BLEMISHES ON ALUMINUM-ZINC ALLOY COATINGS

This is a division, of application Ser. No. 139,607, filed Apr. 11, 1980, now U.S. Pat. No. 4,310,572.

BACKGROUND OF THE INVENTION

This invention relates to the coating of linear material such as metallic sheet, strip, strand, and especially wire, with metallic coatings in a hot dipped coating bath. More particularly the invention relates to the use of protective atmospheres and gas wiping of hot dipped coatings of aluminum-zinc on linear material and particularly wire and the like.

Metallic linear material such as sheets, strip and wire has been economically coated for many years by passing the linear material through a bath of molten metal such as molten zinc or aluminum. Usually the linear material has been a ferrous material such as steel or the like. The resulting outer coating of aluminum or zinc or sometimes other metals or alloys such as tin or terne (an alloy of lead with up to 25% tin) provides corrosion resistance to the underlying ferrous metal.

Linear material passing from a molten metal coating bath usually does not have a satisfactory layer of molten coating metal on its surface. The molten metal coating is invariably either too thick, too uneven, or both, or has some other defect which would prevent the molten metal from solidifying into a satisfactory metal coating upon the substrate metal. As a consequence, it has been customary to wipe the coating in some manner after the linear material leaves the molten coating bath in order to smooth and/or reduce the weight of the coating. Various wiping devices have been used to wipe the coating while it is still molten, including soft wipers such as asbestos and the like, rigid wipers such as rolls and scrapers, and occasionally layers of other materials through which the coated linear material passes. More recently gas wipers, or gas doctors, have been used to forcibly blow a gas such as air, steam or some inert or reducing gas against the molten coated surface of the linear material to remove excess molten metal and smooth the coating of molten metal.

In order to attain good adherence of the coating metal to the substrate metal it is necessary for the surface of the substrate to be clean prior to passage through the molten coating bath. The linear material must therefore be cleaned prior to being coated in order to provide a suitable clean, active substrate surface for contact with the molten coating bath. Once the substrate metal is clean it must be kept clean and active, i.e. oxide free, until it is submerged in the molten coating bath. It is therefore necessary to protect the substrate metal after cleaning either with a coating of flux or else by immersion in an inert or reducing atmosphere. Thus, ferrous linear material frequently enters the molten coating bath in a protective or oxygen excluding atmosphere. The protective atmosphere is composed of either an effectively inert gas or a reducing gas or gases. Inert or reducing atmospheres have also been used to protect the linear material as it exits from the molten bath to prevent detrimental oxidation of the surface of the coating while it is still hot both before and after the coating solidifies.

The protective atmosphere is usually contained in a hood which extends to or into the surface of the molten bath.

With the more frequent use of gas wipers for smoothing and wiping the molten coating, the use of an inert or a reducing gas to wipe the surface of the linear material has sometimes been adopted to prevent surface oxidation. In some installations, and particularly in wire wiping installations, the wiper has been enclosed in or attached to a chamber containing a protective atmosphere so that the molten coating on the wire is completely protected from exposure to the normal atmosphere until it is wiped. Such enclosed gas wiping operations have been more frequently used during the coating of linear material such as wire, rather than when coating larger material having extended transverse dimensions such as sheet or strip because of the difficulty in completely enclosing such larger material and also because the coating of wire tends to be more critical and "touchy" than the coating of sheet and strip. However, there is no overriding reason why wiping enclosures cannot be effectively applied to the coating of sheet and strip as well and some specialized installations have included this refinement.

The use of a non-oxidizing gas as both a wiping and a protective gas has been found to be particularly desirable in the wiping of wire material. Otherwise oxidized coating particles on the molten coating surface tend to increase the viscosity of the molten metal and result in buildup of a thick viscous oxide material layer which seriously interferes with effective gas wiping. The small circumference of the wire allows viscous rings of oxide material to form about the wire and break through the gas barrier resulting in thick rings of coating on the wire. Such coatings after solidification cracks and flake when the wire is bent.

Within the last decade a completely new coating has made its appearance on the market. This coating is composed of an alloy of aluminum and zinc, usually having a composition within a range of about 25 to 70% aluminum. The coating is usually a multi-phase coating having zinc-rich and aluminum-rich regions in the coating overlay and when formed from a hot dip coating, a thin intermetallic alloy layer between the overlay and the base metal. These multi-phase coatings have proven to have superior corrosion resistance and to be both economical and convenient to apply with the use of proper techniques by hot dip coating.

While aluminum-zinc coatings have proven to be very corrosion resistant and otherwise advantageous and to a large extent ordinary hot dipped coating apparatus has been found to be effective in the forming of the new coatings, some special problems have arisen in the production of such coatings and have been solved by new techniques, several of which are the subject of issued patents.

One problem which has arisen in the coating of wire in particular with aluminum-zinc coatings is the occurrence of small discolored depressions or craters in the surface of the final coating. These depressions look like actual bare spots or pin holes through the coatings, but when examined with a microscope prove to be only depressions. Nevertheless, because the coating at the bottom of the depressions is thinner than the surrounding coating and thus more subject to perforation by corrosion, and because the depressions have a burned appearance, which may be considered by many to be a blemish, such depressions or craters are undesirable.

Because of their burned look these depressions have been called "powder burns". This type of blemish appears to be more or less unique to aluminum-zinc coatings. Similar blemishes are not found on galvanized or aluminized products. The defect has appeared usually and most noticeably upon hot dip coated aluminum-zinc coated wire which has been wiped by an inert or reducing gas wiper connected with a hood extending to the bath surface to prevent oxidation of the bath surface. Such an arrangement has been used to avoid the occurrence of oxide inclusions in the surface of the coating and has been successfully used in coating with other coating metals by prior workers.

SUMMARY OF THE INVENTION

The difficulties with so-called "powder burns" described above have now been obviated by the present invention. The inventor has discovered that the small discolored depressions and craters result from the presence of zinc powder particles which are formed above an aluminum-zinc bath by the solidification of zinc vapor. Since an aluminum-zinc bath is maintained at a fairly high temperature of from about 538° C. to 650° C. (1000°-1200° F.) and more preferably between 571° to 621° C. (1060°-1150° F.), depending upon the bath composition, which temperatures are much higher than the usual galvanizing bath temperature of about 430° to 450° C. (806°-842° F.), significant of zinc vaporize or evaporate from the surface of the aluminum-zinc bath. The zinc vapor cools above the bath and forms small solidified zinc particles, zinc dust, or zinc powder, which then settles from any enclosed atmosphere above the bath onto the bath surface where the particles float forming a significant deposit of fine zinc powder particles on the surface of the molten bath. This deposit may vary from a thin film of zinc powder to an actual mound of zinc powder which tends to accumulate or mound up about the wire emerging from the molten coating bath. The deposit of zinc particles is substantially pure zinc, but careful analysis indicates that a very thin oxide film may be present on the outside of at least some particles. Partial oxidation of the surface of the particles is believed to be due mostly to very small fractions of water vapor and/or oxygen in most wiping gases. This very thin oxide film may be responsible for the tendency of the zinc powder to float on the surface of the molten bath and to build up at times into very significant floating deposits. Sometimes an actual crust of zinc powder forms upon the surface. Lateral movement caused by vibration then tends to cause the crust to break up and allow detrimental lumps of zinc powder to be carried up on the wire emerging from the molten bath.

The floating zinc powder particles in particular tend to adhere to the coating on the wire as it is withdrawn from the molten bath. The zinc particles adhere temporarily to the coating surface until it is solidified, but then appear to be dislodged by jarring or otherwise in subsequent cooling steps and during passage of the wire over sheaves and the like. Small discolored craters are left in the coating surface where the zinc particles are dislodged. These small craters are detrimental to both the corrosion resistance and appearance of the wire. Also if a lump of zinc powder is carried up on the wire the lump may remain or if dislodged may result in a significant void in the coating.

While zinc powder also tends to form within any hood or enclosure positioned at the location where wire or other linear material enters a molten aluminum-zinc bath, this zinc powder, unlike zinc powder formed where the wire leaves the molten bath, does not appear to have any detrimental effect upon the final coated product. Although zinc powder formed at the point of entrance of the wire in the molten bath may settle to the bath surface and be drawn down into the bath with the wire as the wire enters the bath, the zinc powder particles or even lumps are melted as they are drawn under the molten bath and are recombined or merged readily into the bulk of the molten bath. This is quite contrary to the action of zinc oxide particles which may form on the bath surface. Oxide particles may be drawn down into the bath with the entering wire and cause later defects on the final coated wire.

Although, at noted above, a very thin film of oxide may possibly form on the surfaces of the zinc powder particles, any such thin film, when or if present, is insufficient to either classify the zinc power particles as oxide particles or to cause the typical oxide inclusion type coating defects. If is only where the zinc particles are deposited on the surface of the molten bath and are then drawn up upon the coated wire as the wire emerges from the bath that difficulty arises with respect to defects caused by zinc powder particles.

The present inventor has now discovered that the difficulties with so-called "powder burns" or small discolored craters in the surface of aluminum-zinc coated wire can be effectively eliminated by preventing contact of zinc powder particles with the molten aluminum-zinc coating material upon the wire or other linear base material or upon the surface of the molten coating bath adjacent to the exit point of the linear base material from the coating bath. Such prevention can consist very broadly of either preventing the effective formation of the zinc powder or preventing the powder from contacting the coated surface of the wire or linear material emerging from the molten coating bath.

Preventing or reducing the effective formation of the zinc powder can be broadly accomplished either by preventing initial formation of the zinc powder or decomposing zinc powder which has already formed before it has a chance to accumulate upon or about the emerging wire. Preventing contact of the zinc powder with the surface of the emerging wire may be broadly accomplished by removing the zinc powder from the vicinity of the exit or emergence of the wire from the molten coating bath or by preventing the zinc powder from contacting the molten aluminum-zinc bath or still molten coating on the wire.

The formation of zinc powder can be reduced, for example, by (a) lowering the bath temperature, (b) reducing the area of the aluminum-zinc bath exposed within the protective gas enclosure, or (c) heating the gas wiper, the protective gas enclosure and/or the wiping gas to retard zinc condensation. While possible, each of these expedients for reducing formation of zinc powder has some operating drawbacks.

A very practical and effective method for preventing zinc powder formation is by the use of a molten or floating particle barrier within the protective gas enclosure.

To prevent the zinc powder from contacting or being deposited upon the coated surface of the emerging wire, the powder must either be prevented from building up around the wire or exhausted from within the enclosure.

The present invention has discovered several particular methods and apparatus which will alleviate the powder burn problem by substantially eliminating the zinc powder from the vicinity of linear material exiting from a molten aluminum-zinc coating bath. A preferred means for minimizing or substantially eliminating the zinc powder is by the use of an orifice or orifices positioned in the lower portion of the hood or protective gas enclosure that surrounds the linear material as it exits from the molten coating bath. It has been discovered that if orifices are supplied in the hood adjacent to the bath surface and the orifices are sized such that a significant flow of gas passes from the interior to the exterior of the hood the zinc dust will be drawn from the hood and difficulty with so-called powder burns will be minimized.

It has also been discovered that the amount of zinc powder in the vicinity of the emerging wire can be substantially reduced by the use of a catcher at the surface of the molten bath within the hood to prevent the deposition of zinc powder upon the bath surface. Zinc powder formed by solidification of zinc vapor in the hood settles upon the catcher surface rather than onto the bath surface and can then be removed periodically from the hood. If the catcher structure is designed to contact the bath surface, furthermore, it serves the additional function of decreasing the exposed bath surface and consequently decreasing vaporization of the zinc vapor from the bath surface, in this manner alleviating the "powder burn" problem.

A very effective and preferred method discovered by the present inventor for alleviating the "powder burn" problem is the use of gas exhaust orifices in the protective gas hood or enclosure as described above in combination with the provision upon the surface of the molten bath of a coating or blanket composed of a chemically stable liquid such as a molten salt. A covering or blanket of floating granular or particulate material may also be used atop the molten metal bath surface to prevent the evaporation of zinc vapor from the molten bath.

It would also be technically feasible to provide radiant heating means above the molten bath surface within or as a part of the hood which radiant heating means will radiate sufficient heat upon the bath surface to immediately melt any zinc dust which is deposited upon the surface. The radiant heat also provides some of the heat necessary to maintain the metal coating bath in a molten state. The additional heat has the disadvantage, however, of increasing the intrinsic zinc vaporization.

It is also possible, of course, to substantially eliminate the zinc powder problem by eliminating the protective hood about the point at which the linear material issues from the molten bath so that any zinc vapor is dispersed into the surrounding atmosphere. Unless the flow of non-oxidizing wiping gas is sufficient to completely blanket the volume surrounding the emerging wire, however, oxidation of the molten coating material is then likely to occur along with all the detriments of such oxidation, particularly when the linear material being coated is wire.

DESCRIPTION OF A PREFERRED EMBODIMENT

Figure 1:
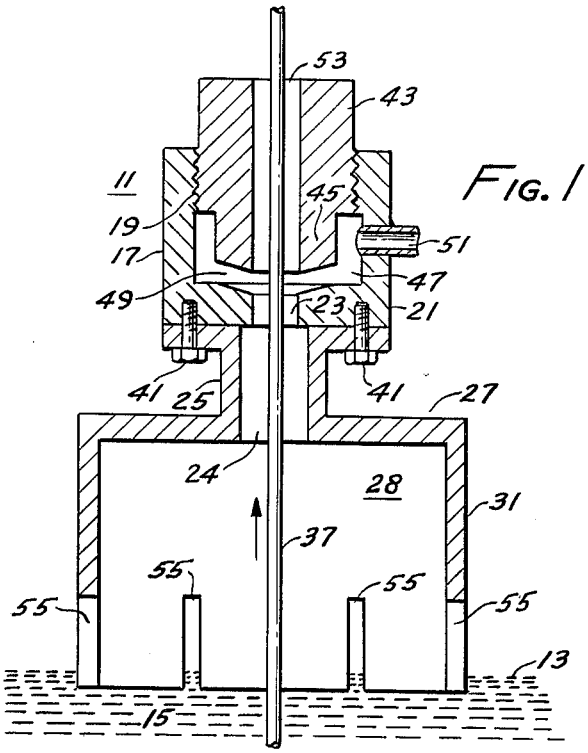
FIG. 1 schematically shows in cross section one form of gas wiper and hood supplied with gas exit slots in the side walls of the hood to remove zinc powder from the interior of the hood.

The present invention provides an improved hot dip coated product from molten aluminum-zinc coating baths. It has been discovered that such baths tend to evolve, or evaporate, relatively copious amounts of zinc vapor due to the thermodynamic potential (measured by the vapor pressure of zinc) for zinc to evaporate at the temperature of the molten bath. Rapid evolution of zinc vapor occurs because the temperature of an industrial aluminum-zinc coating bath is customarily more than 165° C. (300° F.) above the melting point of zinc. The evaporated zinc vapor precipitates in the atmosphere above the molten bath as a fine metal powder. If the material being coated is withdrawn from the coating bath into or through a protective enclosure containing a nonoxidizing gas or the like, the zinc evaporation into the protective enclosure will result in the deposition of fine metallic zinc powder upon the portion of the surface of the molten bath within the enclosure. A considerable buildup of zinc powder may occur on the confined surface of the bath. If this metallic zinc powder buildup is allowed to continue unimpeded, the metallic powder eventually will cover the surface of the bath and mound up about the emerging coated products. The powder readily sticks to the coating on the emerging product, for example coated wire. Subsequent cooling and handling of the wire then dislodges the zinc particles from the coating leaving a depression in the coating. This depression is detrimental to the corrosion resistance of the coating, because it represents a thin place in the coating, and also detracts from the appearance of the coating because the depression tends to be discolored. The present inventor has discovered the cause of these depressions, or "powder burns", and has determind that if the amount of zinc powder can be minimized the powder burn problem can be largely eliminated. The present inventor has developed several different methods and means for minimizing the accumulation of zinc dust within protective hoods and the like and as a consequence has substantially obviated the "powder burn" problem.

An additional disadvantage of building up a heavy layer of zinc dust or powder is that tha powder may form a crust on the surface of the bath. Vibrations may then break up the crust allowing lumps of zinc dust to be drawn up with the linear material from the bath resulting in a lump on the surface of the linear material. Minimization of the zinc powder accumulated upon the surface of the molten bath will also largely eliminate any possibility of the formation of such lumps.

A preferred method and means developed by the present inventor for preventing "powder burns" by minimzing zinc dust in the vicinity of linear material issuing from a molten aluminum-zinc bath provides orifices or openings in a protective hood adjacent the bath surface. A nonoxidizing gas maintains a slight positive pressure within the hood to prevent the entrance of atmospheric oxygen into the hood. The orifices in the hood allow some of the nonoxidizing gas to escape from the interior of the hood to the exterior. This escaping gas entrains zinc dust precipitated from vapor within the protective hood and carries the zinc dust from the hood.

The orifices in the hood may be of various shapes and dimensions so long as they are are dimensioned such that the relative positive pressure prevailing in the gas within the hood creates a substantial current of gas from the interior of the hood or containment means to the exterior. The orifices must also be positioned in the hood adjacent to the bath surface. Preferably the lower portions of the orifices open into the molten bath. The orifices may also be elongated in a substantially vertical direction. Vertical elongation of the orifices is desirable so that minor variations in the level of the molten metal bath will cause a minimum change in the cross sectional area of the orifices. If the orifices were horizontally elongated, on the other hand, and were open to the bath surface, a small change in the level of the coating bath could cause a significant change in cross sectional area of the orifice. If the position of hood with respect to the surface of the molten bath can be precisely and conveniently controlled, however, horizontal orifices positioned at the surface of the bath may provide an even more effective arrangement for the elimination of zinc dust from the interior of the hood and particularly from the surface of the molten bath. If a really precise control of the relative position of the bath surface and the lower portion of the hood can be maintained the hood may be positioned just off the surface of the bath creating a continuous orifice extending completely around the bottom of the hood.

In FIG. 1 there is shown diagrammatically in elevated cross section a generally conventional wiping die and protective hood combination broadly similar to the die arrangement disclosed in U.S. Pat. No. 3,707,400 to Harvey et al. The die 11 is positioned a predetermined distance from the surface 13 of a molten metal coating bath 15. The die is comprised of an outer cylindrical body 17 having internal threads 19 at the upper end within the hollow interior of the cylindrical body. The cylindrical body has a lower end 21 in which there is an orifice 23. Orifice 23 leads into a gas passageway 24 through an upper neck portion 25 of a gas containment or hood member 27, the interior of which comprises a hollow chamber 28 having side walls 31 and an open bottom through which a wire 37 enters the chamber 28. The gas containment or hood member 27 is secured to the bottom of cylindrical body 17 of the die 11 by means of removable machine bolts 41. It will be understood, however, that any other suitable connecting means such as, for example, a threaded connection or the like could be used. While the side walls 31 are conveniently cylindrical, they could be other shapes.

The outer cylindrical body 17 of the die has an inner cylinder 43 threaded into it. The inner cylinder 43 has a depending nose 45 which, when the two cylindrical members are correctly positioned with respect to each other, defines between its surface and the inner surface of the outer cylindrical body 17 an arcuate gas passageway 47. The lower portion of this passageway is extended between the bottom surface of the depending nose 45 and the inner surface of the bottom of the cylindrical body 17 toward the central axis of the die 11 to form a circumferential gas wiping orifice 49. A gas inlet orifice 51 is disposed in the side of the cylindrical body 17 providing access from the exterior of the wiper 11 to the arcuate passsageway 47. The inner cylinder 43 also has a central passageway 53 through which the wire 37 passes upwardly from the wiping die. While only a single inlet orifice 51 is, for convenience, shown disposed in the side of the cylindrical body 17, it is preferable to use several such inlet orifices in order to equalize the gas pressure within the arcuate gas passageway 47.

A series of upwardly elongated or slot type orifices 55 are provided in the side walls of the hollow chamber 28. Four orifices 55 are shown but it will be understood that two more orifices would be present in the front side wall of the hood 27 which is not visible in the cross sectional view in FIG. 1. Any number of orifices can be used so long as the total opening in the side walls is sufficiently restricted in relation to the pressure differential between the inside and outside of the hood to maintain sufficient flow of gas through the orifices to carry zinc powder from the interior of the hood 27 to the exterior. It is also desirable, though not strictly necessary, for the orifices to be more or less evenly spaced from each other in order to encourage even gas exhaustion from the chamber 28. Three substantially evenly spaced orifices have been found to be very effective in a three inch diameter chamber. The total cross sectional area of all the orifices 55 are preferably not more than the cross sectional area of the throat, or orifice 23, of the gas wiping die 11. As disclosed more fully in a concurrently filed application, the total cross sectional area of the orifice or orifices 55 may be from about 5% to a little less than 100% of the cross sectional area of the throat of the die 23, but it is preferred that such cross sectional area be between 20% to 90% of the cross sectional area of the throat of the die. With these dimensions together with sufficient gas flow through the gas wiping orifice 49 and orifice 23 thickness control of the molten coating is also attained as discussed more fully in said concurrently filed application. It will be understood that the present invention does not depend upon the relative sizes of the orifices and the throat of the die but only in the embodiment shown in FIG. 1 on velocity with which the gas passes through the slots. In general if the velocity of gas passing through the slots is sufficient to prevent any significant passage of air in the opposite direction through the slots zinc dust will be exhausted from a reasonably sized hood or chamber.

As shown the exit orifices 55 when used with most coating baths should for best results have a generally elongated vertical slotted shape and should be positioned generally vertically with their lower portions either at the surface of the molten coating bath or slightly below the surface of the molten coating bath. In the latter case, of course, the effective lower limit of the orifice with respect to the gas passing therethrough is the surface of the coating bath.

In operation the wire 37 passes through the molten metal coating bath 15 in any conventional manner, usually down around a lower sinker sheave, not shown, and then up through the bath surface, through the hollow chamber 28, through the neck 25 of the gas containment hood, via the passageway 24, through the orifice or throat 23, past the circumferential wiping gas orifice 49 and finally upwardly through the central passageway 53 of the inner cylinder and out of the gas wiper.

As the wire 37 passes through the circumferential gas wiping orifice 49 it is wiped by a curtain of gas supplied via inlet 51 and arcuate gas passageway 47 which gas has been shaped by the wiping orifice 49. This gas wipes and smooths the molten coating on the wire. Excess coating is in effect pushed back into the molten coating bath. The gas used is preferably a reducing or inert gas such as for example, carbon dioxide, argon, hydrogen, helium, nitrogen, methane, natural gas, nitrogen-methane and nitrogen-hydrogen mixtures and the like. Nitrogen or other gases having a comparable molecular weight or density such as argon are preferred as pointed out more fully in the concurrently filed application previously referred to. Light gases such as hydrogen, helium, methane and the like are less satisfactory. The gas may be conveniently heated by conducting it initially through a single indirect contact preheater, not shown, immersed in the molten coating bath. The gas is directed downwardly and inwardly at an angle toward the wire to aid the wiping action and at least a portion of the gas passes downwardly into the hollow chamber 28 in the gas containment hood 27 where it additionally serves if it is a nonoxidizing gas to protect the molten coating on the wire and the molten surface of the bath from oxidation. Such oxidation would tend to form a coating of oxide on the surface of the bath which could then be drawn upwardly with the molten coating on the wire causing an undesirable roughness on the wire and interfering with smooth wiping of the coating. The reducing or inert gas can, since it protects the molten metal from oxidation, be referred to broadly as the protective gas. Examples of suitable wiping and protective gases are set forth above. Means to collect and treat the protective gas may be used on the exterior of the hood adjacent the slot orifices if it is desired because of cost considerations or otherwise to recirculate the protective gas.

It is desirable in order to avoid excessive wear and erosion of the throat 23 of the die 11 by the passage of the wire to form the throat section from, or face it with, a wear resistant metal such as a hard stainless steel. Likewise, since a molten aluminum-zinc bath containing more than about twenty-five percent aluminum up to about eighty-five percent aluminum is very reactive with ordinary iron and steel it is desirable to form at least the lower edge of the side wall 31 of the protective chamber where it contacts the molten bath 15 from stainless steel or another material which is very resistant to attack by molten aluminum-zinc alloys, for example AISI designation 316L stainless.

Figure 2:
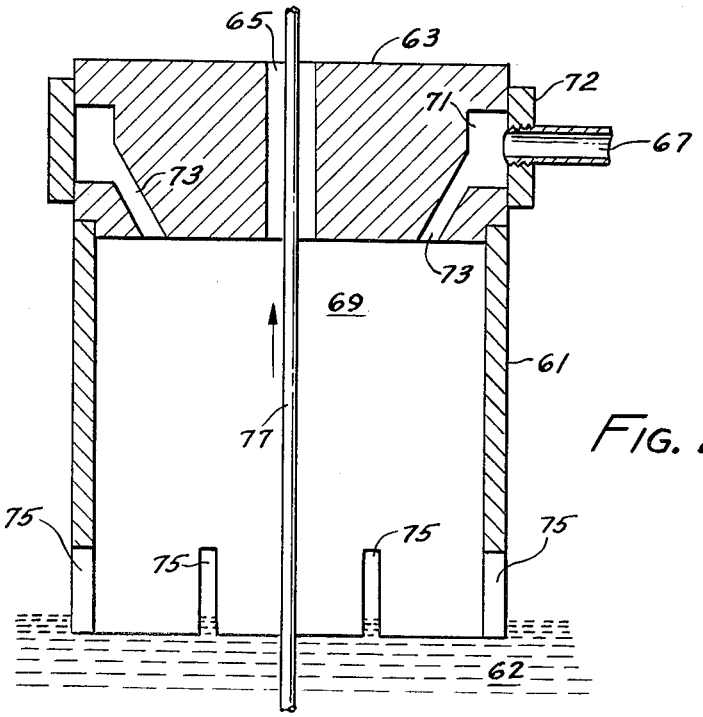
FIG. 2 shows schematically in cross section a protective hood arrangement without an associated gas wiper but provided with the gas exit slots of one embodiment of the invention.

In FIG. 2 there is shown an arrangement in which a protective hood surrounds a wire exiting from a molten aluminum-zinc bath, but no gas wiping die is associated with the hood. The hood shown in FIG. 2 is similar in some respects to the protective hood shown in U.S. Pat. No. 3,632,411, but has a greater diameter. A cylindrical body 61 has its lower end immersed in a molten aluminum-zinc bath 62 and its top closed by a closure member 63 having a wire exit orifice 65 in the top. A protective gas supply pipe 67 evenly supplies a protective gas into the top of the chamber 69 within the cylindrical body 61 through an annular distribution passage 71 in the closure member 63 from which the gas passes into the chamber 69 through a series of more or less evenly spaced gas orifices 73, only two of which are shown. Elongated slots 75 are positioned generally vertically in the lower portion of the walls of the cylindrical body 61 adjacent the surface of the molten bath 62. The annular distribution passage 71 in the closure member 63 has an outer wall comprised of an annular ring 72 into which the supply pipe 67 may be threaded.

In operation a wire 77 passes through the molten aluminum-zinc bath 62 and up through the protective chamber 69, passing ultimately from the chamber through the wire exit orifice 65 in the top. The protective gas entering the chamber 69 from the gas supply pipe 67 via passage 71 and orifices 73 fills the chamber and escapes via the wire exit orifice 65 and the elongated slots 75. Sufficient protective gas is provided to maintain a positive pressure within the chamber 69 and so that there is sufficient gas flow through the wire exit orifice 65 and the elongated slots from the interior of the chamber to the exterior of the chamber to prevent the entrance into the chamber 69 through the openings of atmospheric gases which might oxidize the molten metal either on the surface of the molten bath or the surface of the coated wire passing through the chamber. With such a flow of gas it will be found that zinc powder which forms within the chamber 69 will be swept from the chamber and particularly from surface of the molten bath and through slots 75 preventing a buildup of zinc powder on the surface of the molten metal and avoiding the occurrence of zinc powder defects or blemishes such as "powder burns" upon the surface of the coated wire.

While the use of orifices or slots in the protective hood has been described above with some specificity, it will be understood that the invention broadly may be useful when a nonoxidizing protective gas is to be used in any form of protective chamber or containment means through which a linear or other material passes from a molten aluminum-zinc bath. Alleviation of the defects caused by the presence of zinc powder in the vicinity of the exit of the linear material from the molten bath in accordance with the invention involves the provision of orifices in the protective chamber adjacent to the surface of the molten bath. A current of gas is maintained through these orifices in a volume sufficient to carry or sweep any metallic zinc particles from the vicinity of the surface of the molten bath through the orifices. The precipitation of such particles upon the surface of the molten bath and their ultimate withdrawal upon the molten coating on the wire as it is drawn from the molten bath is thus prevented. Particles which might otherwise settle upon the surface of the molten bath within the protective chamber are swept from the chamber. In addition, zinc powder already deposited upon the surface of the molten bath tends to be picked up and swept from the protective chamber through the orifices. In order to obtain sufficient sweep of gas through the orifices, sufficient nonoxidizing gas must be supplied to the protective chamber from the gas supply means. If the protective chamber is being used with a gas wiping die and receives its protective gas from the die, the gas flow through the orifices will be quite adequate if the total orifice cross sectional area—plus the area of any other openings in the protective chamber—is less than the cross sectional area of the throat of the wiping die. Assuming that sufficient gas is supplied to induce a flow sufficient to effectively wipe the wire or other linear material there will be sufficient flow to sweep zinc powder from the protective chamber. A comparable flow is satisfactory through the orifices of a protective chamber not associated with a gas wiping die or in which the orifices in the protective chamber do not have a smaller cross sectional area than the throat of the wiping die. In general it may be stated that if the flow of inert or nonoxidizing gases through the orifices is sufficient to prevent the entrance of significant amounts of atmospheric gases into the protective chamber through the orifices there will be sufficient flow to exhaust zinc powder particles from the chamber. It will also, of course, be necessary for the protective chamber to have a size such that a gas stream sweeping through the orifices induces a significant flow of gas through the chamber. As an example, it has been found that a cylindrical protective chamber associated with a wiping die and having a diameter of three inches will be satisfactorily maintained effectively free of zinc powder when the associated wiping die is supplied with from 10 to over 500 cubic feet per hour of nitrogen at a pressure of up to 6 pounds per square inch. Broadly any flow of protective gas outwardly through an orifice in a protective chamber side wall disposed adjacent a molten bath surface, which flow is sufficient to prevent an inward flow or migration past the outward flow of a significant amount of atmospheric or surrounding gases, will constitute sufficient gas flow to effectively sweep zinc powder particles from the interior of the protective chamber.

A second novel means to prevent the occurrence of powder burns on molten metal coated linear material comprises a catcher or tray which is positioned within the interior of a protective hood or enclosure to prevent zinc powder particles from settling upon the molten bath surface.

Figure 3:
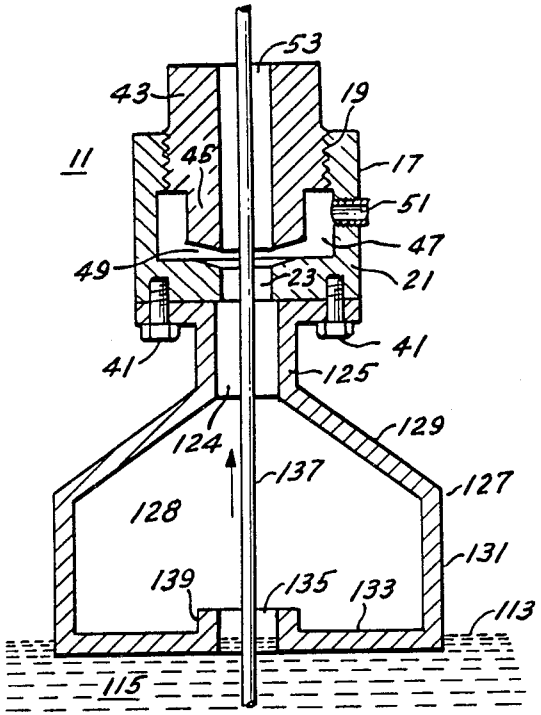
FIG. 3 shows schematically in cross section a wiper and hood supplied with one embodiment of zinc powder removal arrangement in accordance with the invention.

In FIG. 3 there is shown in elevated cross section a conventional gas doctor type wire wiping die broadly similar to the die disclosed in U.S. Pat. No. 3,707,400 to Harvey et al. The wiping die portion of the apparatus is identical to the wiping die shown in FIG. 1 and thus similar structures in the die portion of the apparatus have been given the same identifying numbers. For a description of these structures reference may be had to the description in connection with FIG. 1. The lower end 21 of the cylindrical body portion of the die 11 has an orifice 23 leading into a continuous or hood member 127, the interior of which comprises a hollow chamber 128. The containment member 127 is a variation of the containment member 27 in FIG. 1 and similar structures of the containment member in FIG. 3 have been identified with numerical designations which are exactly one hundred ordinal numbers higher, thus for example 127 instead of 27 and the like. Where dissimilar structures are involved new numerical designations have been used. The orifice 23 leads into a gas passageway 124 through the upper neck portion 125 of the cylindrical gas containment or hood member 127 into the hollow chamber 128. The gas containment member 127 has sloping upper walls 129, straight cylindrical side walls 131 and a bottom closure 133 having a central opening 135 through which a wire 137 enters the chamber 128. Preferably the bottom closure 133 includes an upward cylindrical extension or dam 139 about the central opening 135.

In operation the wire 137 passes through the molten aluminum-zinc bath in any suitable conventional manner, usually down around a lower sinker sheave, not shown, and then up through the bath surface, through the central opening 135 in the bottom closure 133, which may also be called a catcher or tray, up through the hollow chamber 128, through the neck 125 of the gas containment hood via the passageway 124, through the orifice 23, past the circumferential wiping gas orifice 49, and finally upwardly through the central passageway 53 of the inner cylinder and out of the gas wiper.

As the wire passes by the circumferential gas wiping orifice 49 it is wiped by a curtain of gas which has been shaped by the wiping orifice as explained in connection with FIG. 1. The gas used is preferably a reducing or inert gas such as, for example, carbon monoxide, argon, helium, hydrogen, nitrogen, methane, carbon dioxide, methane-nitrogen mixtures and the like. This nonoxidizing or protective gas is directed downwardly and inwardly at an angle toward the wire to aid the wiping action and at least a portion of the gas passes downwardly into the hollow chamber 128 in the gas containment hood 127 where it additionally serves to protect the molten coating on the wire and the molten surface on the bath from oxidation.

When coating with a molten aluminum-zinc alloy in the apparatus shown the heat of the molten bath necessary to keep the alloy melted is sufficient to cause a significant vaporization of the lower melting zinc from the surface of the molten bath. This vaporized zinc collects in the protective atmosphere in the containment hood 127. The transverse dimensions of the chamber 128 also define a two dimensional area substantially greater than the area of the bath surface exposed through the central opening 135 to the protective atmosphere within the chamber 128. Consequently, most of the volume in the chamber is displaced horizontally from over the small amount of surface of the bath exposed in the central opening 135. Thus as the zinc vapor is cooled and solidifies into zinc powder particles and then settles from the protective atmosphere, the particles fall upon the top surface of the bottom closure 133 where they collect. Because most of the zinc particles precipitate and fall from a portion of the interior of the chamber 128 which is located over the closure or catcher, most of the zinc powder particles will settle upon the catcher rather than upon the small area of exposed molten bath surface. The catcher or tray 133 also restricts movement of the bath surface toward the emerging wire and thus decreases dragging of zinc powder along the surface to the wire.

By substantially greater it is meant that the transverse area of the hood at its greatest transverse dimensions is greater than the area of the exposed bath surface preferably by a factor of at least about 10, and most preferably by about 20 or even 50 to one or more. In other words the transverse area of the chamber 28 should for best results be at least about ten times greater than the area of the exposed bath surface and preferably at least twenty times greater. The perpendicular dimensions and general shape of the hood should of course be in reasonable proportion with the transverse dimensions. A chamber 128 having a volume which is relatively great compared to the area of bath surface exposed and having substantially greater transverse dimensions than the exposed bath surface as defined above may be calld an expanded chamber.

A considerable deposit of zinc dust can accumulate on the top surface of the bottom closure, or catcher, 133 over a period of time. The dam 139 about the central opening 135 serves to prevent this deposit from overflowing into the central opening onto the bath surface. At periodic intervals the coating process can be stopped and the hood detached from the die by removal of this machine bolts 41. The accumulated zinc dust can then easily be removed. Since only a small amount of molten bath surface area is exposed, the zinc in the bath vaporizes at a fairly slow rate and the buildup of zinc dust over a period is not too rapid.

Figure 4:
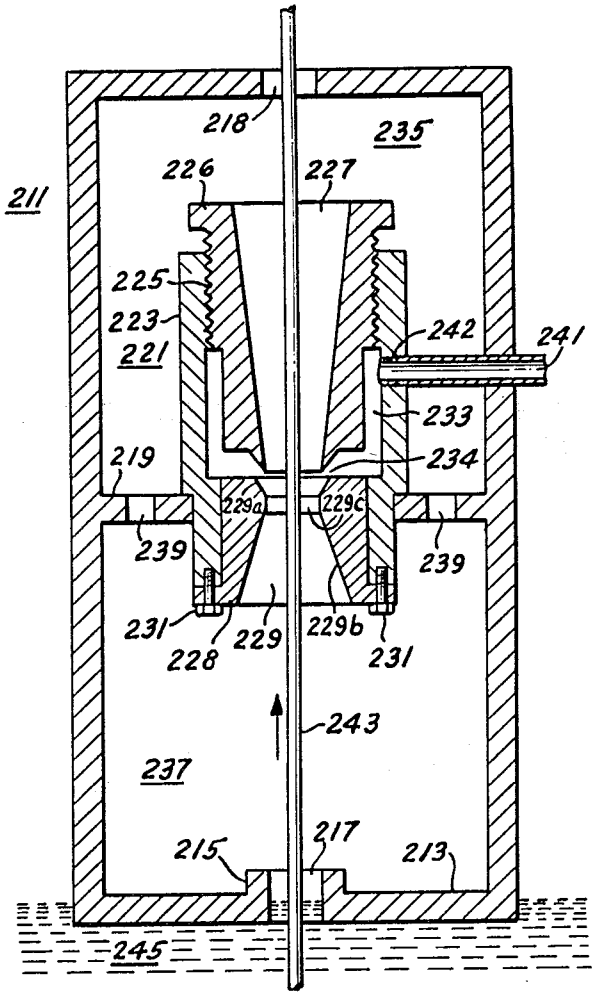
FIG. 4 shows schematically in cross section an alternative form of gas wiper and hood arrangement supplied with a zinc powder removal arrangement in accordance with the invention.

In FIG. 4 there is shown a further desirable arrangement of a gas wiping die and protective hood for the coating of wire. In FIG. 4 there is shown a cylindrical hood 211 having a bottom closure 213 similar to the bottom closure 133 shown in FIG. 3. As in FIG. 3 it is preferable to have a dam 215 disposed about the central opening 217 in the bottom closure 213. The cylindrical hood 211 shown in FIG. 4 has an exit orifice 218 in the center of the top of the hood. The hood also has a circumferential bracket 219 in the center having a central opening in which there is mounted a gas wiping die 221 comprised of an outer cylindrical body 223 having internal threads 225 into which is threaded an inner cylindrical member 226 having a central conical throat 227. This construction of a gas wiping die is available from M. G. Steele, Inc. and is described generally in U.S. Pat. No. 3,270,364 issued to M. G. Steele in 1966. A cylindrical throat member 228 having a interior passage 229 in the shape of two opposed conical sections **229*a* and 229*b* connected by a central cylindrical section 229*c* is positioned in the bottom of the outer cylindrical body 223 and secured in place by machine bolts 231. An annular passageway 233 between the outer cylindrical body 223 and the inner cylindrical member 226 is connected to a circumferential gas wiping orifice 234 which leads to the upper portion of the interior passage 229. The circumferential bracket 219 which supports the wiping die 221 divides the cylindrical hood 211 into an upper chamber 235 and a lower chamber 237. The lower chamber is in direct communication through openings or orifices 239 with the upper chamber 235. A gas inlet pipe 241 passes through the side of the hood 211 and is threaded into an opening 242 in the outer cylinder body 223 leading into the annular passageway 233**.

In operation a wire 243 passes up through a molten coating bath 245 through the central opening 217 in the bottom closure member 213, through the lower chamber 237 and through the wiping die 221, where it is wiped by a curtain of inert or reducing gas issuing from the circumferential gas wiping orifice 234, and into the upper chamber 235 from which the wire 243 exits through the exit orifice 218.

The wiping gas after wiping and smoothing the coating on the wire as it passes through the circumferential orifice 234 passes downwardly through the interior passage 229 of the throat member 228 into the lower chamber 237 of the hood 211 where the gas, which is preferably an inert or nonoxidizing gas, shields the molten coating on the wire and the molten surface of the coating bath 245 from oxidation. The protective gas then passes up through the orifices or openings 239 into the upper chamber 235 where it continues to shield the wire and finally is exhausted through the exit orifice 218 in the top of the hood. If the wiping and shielding, i.e. protective, gas is a reducing gas it is preferably burned as it passes through the exit orifice 218.

As in FIG. 3 zinc vapor will evaporate from the exposed surface of the molten coating bath and also from the surface of the still molten coating on the coated wire and disperse in the lower chamber 237 of the hood 211. The vaporized zinc cools and solidifies into small particles of zinc in the chamber 237. This fine zinc powder settles onto the closure tray 213 in the bottom of the hood from which it can be collected periodically. Some of the zinc particles and zinc vapor will be drawn tith the gas through the orifices 239 into the upper chamber 235, but this amount will be relatively small. In some cases the orifices or openings 239 between the upper chamber 235 and the lower chamber 237 will be the openings between only a minimum of supporting webbing or struts holding the wiping die 221 centered in the enclosure 211. In this case more zinc powder may reach the upper chamber and even be exhausted from the upper chamber 235 through opening 218. Most of the zinc powder will still, however, be deposited upon the bottom closure 213 from which it can be periodically removed. The closure 213 also minimizes the surface area of the molten bath exposed to the protective atmosphere and thus minimizes the amount of zinc which is evaporated from the surface of the bath. The production of zinc powder is thus also decreased in this manner.

Figure 5:
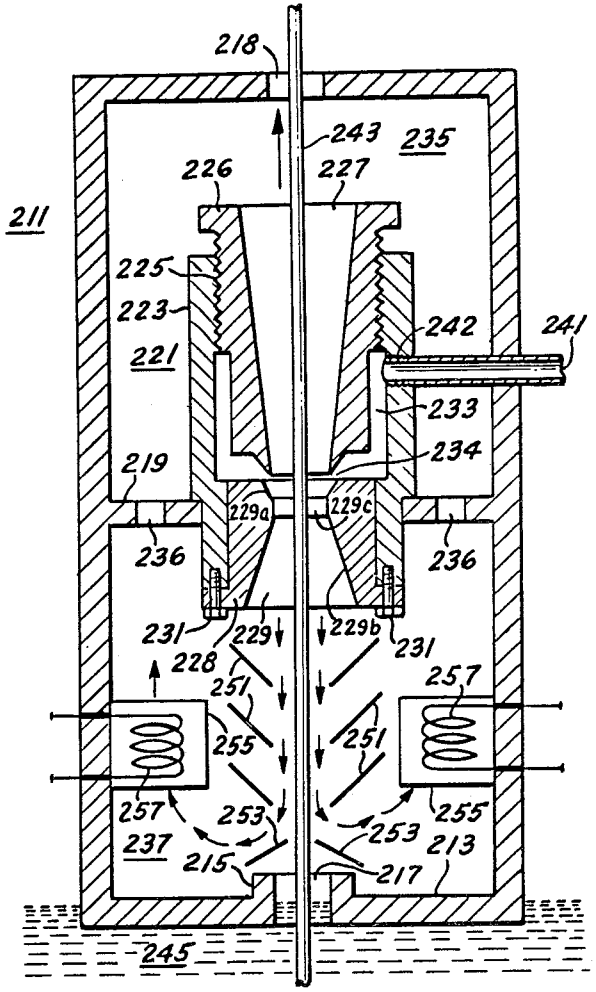
FIG. 5 shows schematically in cross section a still further embodiment of the invention supplied with baffles and cooling means to aid in removing zinc powder.

In FIG. 5 there is shown a variation of the arrangement shown in FIG. 4. Similar structures in the two FIGURES have been given the same identifying numbers and for a description of these structures reference may be had to the description in FIG. 4. In addition to FIG. 5 there is shown an arrangement of gas baffles 251 which is provided to direct the wiping gas issuing from the interior passage 229 of the throat member 228 in a path more or less parallel to the wire until it reaches the bottom of the chamber 237 where it is turned aside by the baffles 253 as shown by arrows in FIG. 5 and is directed upwardly to an annular or circumferential internal chamber or chambers 255 in the hood 211 in which cooling coils 257 through which cooling water or the like flows serve to quickly condense the zinc vapors and cause them to precipitate as zinc powder particles. The fine zinc powder then settles down onto the tray member 213 or onto special catcher or tray members, not shown which may be provided in the chamber 255. As an alternative the cooling chambers may be disposed externally of the hood 211 and the gas may be withdrawn by means of a fan or other suitable gas mover through the cooling coils in the chamber and then returned to the upper chamber 235 or otherwise exhausted. It is somewhat easier in such an arrangement to provide a catching arrangement by which the zinc powder deposits can be collected and removed without disturbing operation in the wiping die.

It will be understood in this regard that as the gas passes from the center of the hood across the upper portion of the baffles 253 that it will withdraw or suck gas from the vicinity of the surface of the bath in the central opening 217 by aspiration and will thus remove zinc vapors from the vicinity of the molten bath surface before they can solidify into zinc powder which might precipitate upon the bath surface.

While the embodiments of the invention shown in FIGS. 3, 4 and 5 have been described in connection with a wire coating operation, the invention may be applicable to any continuous type coating operation where gas wiping means are used and there is a hood reaching to the bath surface in which vaporized metal may be restricted until it cools as a fine powder which may then be deposited upon the bath surface with detrimental results. The principal elements of the invention for effective operation are an expanded chamber to at least somewhat disperse the metal vapors prior to cooling and solidification to minimize the concentration of vapors over the bath and a means to catch or collect solidified metal particles which settle from the expanded chamber. By expanded chamber is meant a containment chamber or hood which has a greater horizontal cross sectional area than the area of exposed bath surface.

It will also be understood that while the invention is most useful with a gas wiping apparatus that it could also be applied to any hood arrangment containing a protective gas above a molten aluminum-zinc bath.

The closure means will intercept a major proportion of the solidified metal particles which settle straight down upon it depending upon its relative area with respect to the area of bath surface exposed. For example, if the ratio of exposed bath surface to closure means area is 1 to 10, about 90% of precipitated metal particles will normally be caught. More concisely the number of metal particles intercepted by the closure rather than impinging upon the bath surface will depend upon the relative volume of space within the containment chamber over the bath and over the catcher or closure. Slanted, i.e. downwardly converging, walls on the containment chamber may also direct a relatively large amount of metal particles into a relatively small closure or catcher. Thus while it is preferred to have at least a 1 to 10 ratio between the area of the bath surface, and most preferably at least a 20 to 1 ratio, any reasonable ratio will serve to intercept a portion of the precipitated zinc powder and will thus serve to at least partially alleviate the powder burn problem.

In addition to the above means for eliminating zinc powder from the vicinity of linear material issuing from the molten coating bath the following means and arrangements can be used.

Figure 6:
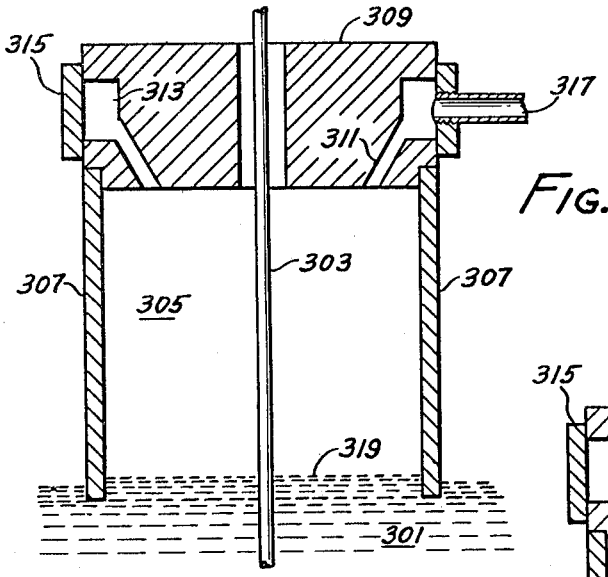
FIG. 6 shows schematically in cross section a molten aluminum-zinc bath within a protective hood having a protective blanket or coating of a molten salt or a granular solid material floating upon the surface of the molten metal coating bath.

In FIG. 6 there is shown an aluminum-zinc coating bath 301 from which linear base material in the form of a ferrous wire 303 is issuing. The wire 303 is surrounded by a protective hood or enclosure 305. The enclosure 305 comprises a sidewall 307 and a top 309 in which there are gas orifices 311 which lead from a circular gas conduit 313 closed by an outer ring 315 as shown in FIG. 6 into which is threaded a gas tube 317 through which a protective gas may be fed into the conduit 313. A protective blanket 319 of a molten salt such as an alkali or alkaline earth chloride or fluoride or, alternatively, a granular material such as glass or ceramic beads, floats on the surface of the molten aluminum-zinc bath and prevents zinc evaporation from the molten bath.

The two major requirements for a salt cover are (1) that it be molten at the temperature of the multicomponent bath (in the case of an aluminum-zinc bath about 571°–632° C. (1060°–1150° F.) and (2) that any salt residues which may remain on the coating after it leaves the coating bath will be removed by a water rinse. These requirements are met, for example, by mixtures of alkali and alkaline-earth chlorides and fluorides. Cryolite and similar double salts can be added in controlled amounts. The result is a fluid, chemically stable, molten barrier which substantially eliminates zinc evaporation from the exposed surface of the molten aluminum-zinc bath.

While the use of a salt cover on the molten bath is shown in FIG. 6 in connection with only a protective chamber, it will be understood that the salt cover can also be used in connection with a protective chamber and wiping die combination as shown in previous FIGURES.

When the molten coating is wiped by a gas wiper as it exits from the molten bath, it will be found that under identical wiping conditions the coating weights are somewhat less when using a molten salt cover than without the cover. This is true even when only a very thin film of molten salt floats upon the molten metallic coating bath. A salt cover which assumes a semi-solid form, i.e. remains substantially granular in form except for a molten film along the actual aluminum-zinc surface, is especially effective because the film provides complete protection against zinc evaporation and is continuously renewed by melting of the excess salt granules in contact with the molten bath. Such a dual phase cover is provided, for example, by increasing the proportion of fluoride salts in the mixture of alkali and alkaline earth chlorides and fluorides. A preferred composition for the salt is about 10% potassium fluoride, 10% aluminum fluoride and 80% sodium chloride-potassium chloridelithium chloride eutectic composition.

The use of a molten salt has the further advantage that the salt tends to be drawn up in a very thin film upon the molten coating on the wire emerging from the coating bath and the retard evaporation of zinc vapor from the surface of the molten coating.

When a pure granular or particulate cover is used the requirements are (1) that it float on the molten metal coating bath, (2) that it can be packed densely enough to substantially cover all of the exposed molten coating bath surface and (3) that the particulates are large enough or dense enough so that they are not drawn up with the coated material adhered to the coating in the same manner that the zinc dust or powder adheres to the coating. Suitable particulate materials are ceramic, glass or other molten aluminum-zinc resistant materials in the shape of beads or other noninterlocking, free-flowing shapes. As with a molten cover, a granular cover tends to result in a slightly decreased coating weight as compared to no cover at all.

Figure 7:
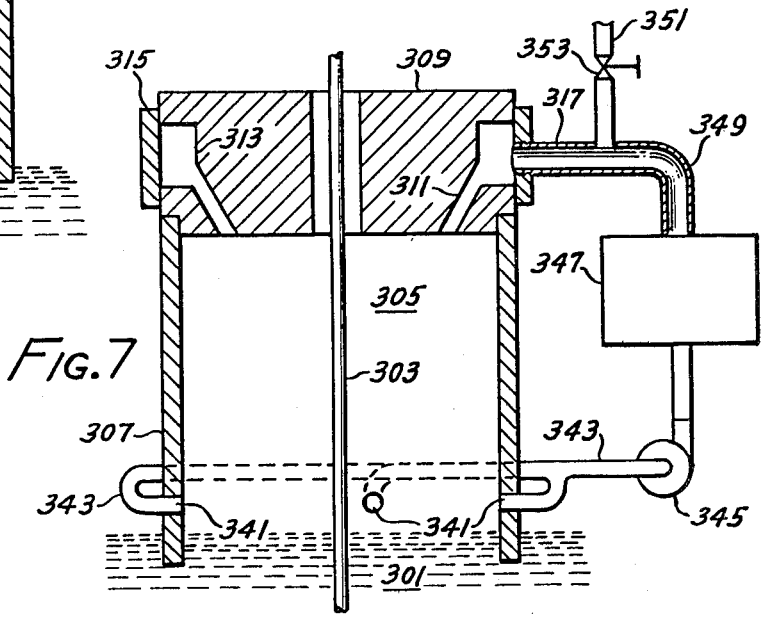
FIG. 7 shows schematically in cross section a protective hood arrangement in which the atmosphere within the hood is continuously withdrawn and filtered to remove zinc particles and then returned either to the hood or to the gas wiper.

In FIG. 7 there is shown a still further apparatus designed to remove zinc powder from the interior of a protective hood through which linear material exits from a molten aluminum-zinc bath. The hood is illustrated for convenience as the same hood arrangement as shown in FIG. 6 and the same designating numbers are used for identification of the various parts. Instead of having a molten salt or a particulate blanket floating on the surface of the bath, however, a series of exhaust orifices 341 are provided in the lower portion of the hood 305. The exhaust orifices are connected by conduits 343 with a centrifugal exhaust pump 345 which provides a substantial exhaust force on the protective atmosphere within the hood drawing the atmosphere and its contained zinc powder particles from the hood and forcing it into a filtering chamber 347 where a series of fine wire filters, not shown, filter the zinc powder particles from the atmosphere. The protective atmosphere gases are then returned to the hood 305 through return conduit 349. Additional make up protective atmosphere gas is added to the circuit when necessary through make-up line 351 and valve 353. The filters used in the filtering chamber 347 must have a mesh size which will remove the zinc powder entrained in the gas. It is necessary, of course, for the zinc to be in a solid particulate form and not a vapor form as it passes into the filters, otherwise the filters would become clogged. It may in some cases, therefore, be necessary to provide cooling coils or the like in the initial portion of the filter chamber in order to assure that the zinc is in solid particulate form when it contacts the filters. If the entrained zinc powder can be cooled sufficiently it may be possible to substitute a more efficient (from a particulate removal standpoint) cloth filter arrangement for the wire mesh filters. In other instances it may be possible also to substitute centrifugal particulate removal apparatus for the filtering arrangement. Suitable specific filter and centrifugal particulate removal arrangements will be readily devised by those skilled in the particulate removal arts.

Figure 8:
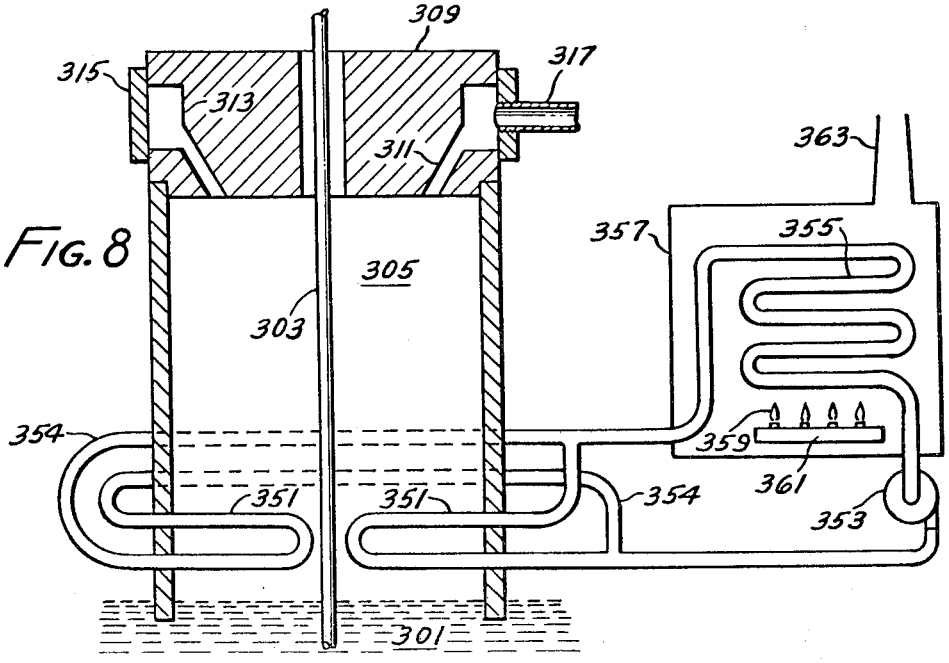
FIG. 8 shows schematically in cross section a protective hood arrangement in which a heating means is used to eliminate zinc powder by melting it into the molten coating bath.

In FIG. 8 there is shown a protective hood similar to the hood shown in FIGS. 6 and 7 positioned at the surface of a molten coating bath from which a wire is emerging. The parts of the hood or protective enclosure itself are the same as those of the hoods shown in FIGS. 6 and 7 and for simplicity the same designating number are used for reference to similar parts. Instead of having a covering or blanket of a liquid salt or particulate material disposed upon the surface of the molten bath 301 as shown in FIG. 6, however, or an exhaust apparatus 347 as shown in FIG. 7, there are provided instead a series of heating coils 351 disposed adjacent to the molten coating bath surface. A hot heat exchange metal such as mercury, molten zinc or some other high temperature heat exchange material is pumped by the pump 353 through connecting conduits 354 to and through the coils 351 from a second series of heat exchange coils 355 disposed in a heater 357. Flames 359 from a burner 361 serve to heat the coils 355 as the hot gases from the flames 359 pass upwardly through the coils 355 and out the stack 363. The coils 351 are maintained at a temperature well above the melting temperature of zinc so there is sufficient radiation from the coil surfaces to promptly melt any particulates of zinc that settle upon the bath surface. The heat from the coils 351 also supplies through the surface of the bath some of the heat necessary to maintain the bath 301 molten. It is necessary for the protective gas in the hood to be very pure so that very little oxidation of the surface of the particulates takes place and they are easily melted and merged into the molten bath surface thus effectively destroying or decomposing the particulates. The temperature of the heating coils 351 should be at least 482° C. (900° F.) and preferably higher. The melting temperature of pure zinc is 419.5° C., or approximately 785° F. It is undesirable, however, to have the coils 351 at too elevated a temperature because the elevated temperature in itself tends to increase the evaporation or vaporization of zinc from the bath and also will decrease the soldification rate of the coating upon the linear material passing through the protective hood. Electric heating coils or rods could, of course, be substituted for the coils 351 in the chamber 305.

Figure 9:
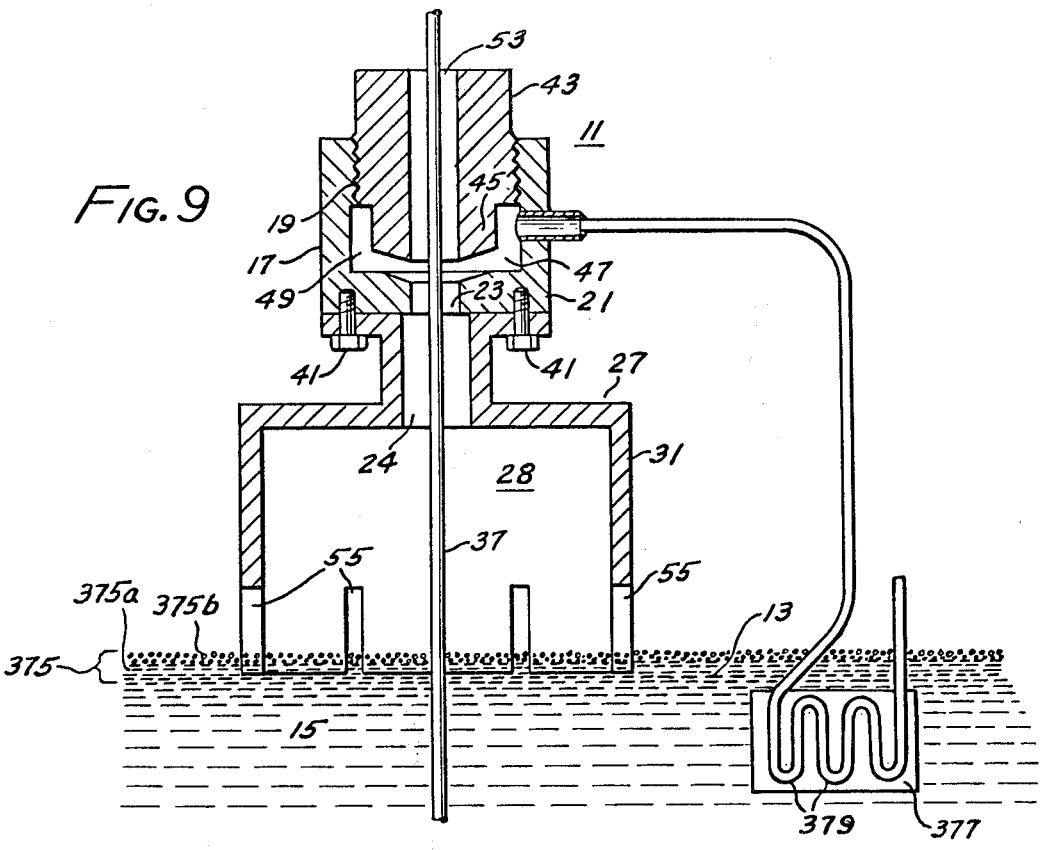
FIG. 9 shows schematically in cross section a preferred arrangement for eliminating zinc powder from the interior of a protective hood.

FIG. 9 shows in schematic cross section a preferred arrangement for eliminating powder burns and other defects caused by precipitated zinc powder from aluminum-zinc hot dip coated linear material which has been wiped with a gas wiping arrangement. This arrangement is essentially a combination of the slotted enclosure arrangement shown in FIGS. 1 and 2 and the protective blanket arrangement shown in FIG. 6. The hood and wiper arrangement is illustrated for convenience as being the same as that shown in FIG. 1 and the same designating numbers as in FIG. 1 are used for identification of the various parts. A combination salt particulate-molten salt blanket or barrier 375 is shown floating upon the surface of the molten aluminum-zinc bath 15. The particulate-molten salt barrier 375 is comprised of a lower molten salt portion 375(*a*) which floats upon the surface of the molten aluminum-zinc coating bath and a particulate portion 375(*b*) which floats upon the molten salt portion 375(*a*) and serves to replenish the underlying molten salt portion as necessary. Since the protective chamber or hood 28 has gas slots 55 in the side walls 31, the floating protective barrier 375 covers not only the surface 13 of the bath 15 within the hood 28, but also the surface of the molten bath outside of the hood and forms the effective lower edge of the gas slots 55.

In operation the wire 37 passes through the molten aluminum-zinc coating bath 15 and up through the bath surface, through the hollow chamber 28, through the neck 25 of the gas containment hood, via the passageway 24, through the orifice or throat 23, past the circumferential wiping gas orifice 49 and finally upwardly through the central passageway 53 of the inner cylinder and out of the gas wiper.

As the wire passes through the circumferential gas wiping orifice 49 it is wiped by a curtain of gas, preferably low dew point nitrogen which has preferably, but not necessarily, been preheated by passage through a preheater 377 having coils 379 immersed in the molten aluminum-zinc bath 15 through which coils 379 the wiping gas passes prior to passage into the gas inlet orifice 51 and thence through arcuate gas passageway 47 and through the wiping orifice 49. The blast of heated wiping gas wipes and smooths the molten coating on the wire and then passes into the hollow chamber 28 in the gas containment hood 27. The protective gas within the chamber 28 serves to prevent oxidation of the surface of the molten metal on both the molten aluminum-zinc bath and particularly in this instance upon the wire issuing from the molten bath. The protective gas also builds up a positive pressure within the chamber 28 relative to the pressure on the exterior of the chamber. This positive pressure results in a flow of gas from within the chamber 28 to the exterior of the chamber through the upwardly elongated or slot type orifices 55. The positive pressure within the chamber 28 and the size or total cross sectional area of the slots 55 must, in order to avoid entrance of oxygen from the atmosphere into the chamber, be such that the flow of gas outwardly through the slots or orifices is sufficient to prevent a back flow of any significant amount of atmospheric gas, i.e. air, through the slots into the interior of the chamber. If the outward flow of gas from the interior to the exterior of the chamber is sufficient to prevent the backflow, or inward flow, of atmospheric gases through the slots, the flow of gas will also effectively sweep zinc powder particles from the interior of the chamber. Zinc powder is swept very effectively in particular from the surface or adjacent to the surface of the molten bath, to the exterior of the chamber. An accumulation of the zinc powder on the surface of the molten metal bath which might cause powder burns on wire or other linear material exiting from the molten bath is thus prevented or minimized.

At the same time the semi-molten layer of halide salts, and preferably alkali or alkaline-earth chlorides and fluorides, prevents evaporation of any substantial amount of zinc from the surface of the molten aluminum-zinc bath. The precipitation of zinc powder within the chamber as a result of cooling the zinc vapors is thus minimized. The semi-molten layer of halide salts also serves to protect the surface of the molten aluminum-zinc bath from oxidation.

Most preferably the layer of particulate-molten material provided on the bath surface will be made up of about 10% potassium fluoride (KF), 10% aluminum fluoride ($AlF_3$) and 80% sodium chloride (NaCl)-potassium chloride (KCl)-lithium chloride (LiCl) eutectic composition. This composition provides a particulate blanket which floats on the top of a molten layer of halide salt which in turn floats on the surface of the molten metal bath. The molten salt layer provides a floating barrier which retards evaporation of salt from the surface of the bath. The floating molten salt barrier is continuously replenished by progressive melting of the particle bed of salt which floats upon the molten salt barrier layer. The combined use of a molten salt barrier layer and slots or orifices adjacent to the surface of the coating bath will for all practical purposes completely or substantially eliminate all powder burn and other defects caused by zinc powder on wire or other linear material issuing from the molten aluminum-zinc coating bath.

Figure 10:
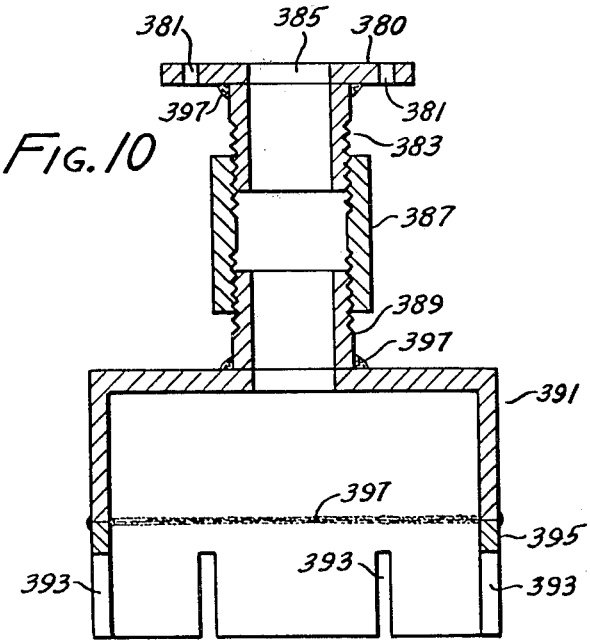
FIG. 10 shows in schematic cross section a preferred form of hollow protective chamber.

FIG. 10 shows in schematic cross section a preferred form of hollow protective chamber arrangement. A mounting plate 380 is provided with bolt holes 381 by which the mounting plate may be secured to the wiping die 11 shown for example in FIGS. 1 or 3 by bolts 41 respectively. An externally threaded tubular section 383, which may comprise a steel pipe nipple, is welded to the mounting plate 377 concentric with an opening 385 in the mounting plate. An internally threaded coupling 387 is threaded over the lower end of the threaded section 373 and serves to adjustably and detachably secure a second externally threaded tubular section 389 to the first tubular section 379. Welded to the lower end of the threaded tubular section 389 is a cylindrical chamber 391 having slots 393 in its lower edge. The cylindrical chamber 391 is preferably composed of stainless steel such as, for example, AISI type 316L stainless steel. It has been found that stainless steel is not reactive with molten aluminum-zinc, although ordinary carbon steel is extremely reactive. Thus, since the lower edge of the cylindrical chamber 391, in operation is immersed in the molten aluminum-zinc bath it is very desirable to form at least the lower rim 395 of the chamber 391 from stainless steel. As shown in FIG. 10 a stainless rim 395 is secured by welds 397 to the plain steel upper portion of the chamber 391. Welded metal securing 379 and 383 and 389 and 391 together is also, for convenience, designated as 397. The entire chamber 391 may very conveniently be fabricated from a section of stainless steel pipe. The size of the chamber 387 is not important. The chamber may be a few inches in diameter and height or may be larger. However, if the slots 389 are to be effective in removing zinc powder from all internal areas of the chamber, the chamber should not be too large, particularly with respect to the diameter of the chamber adjacent to the surface of the molten bath. A diameter of 2 to 4 inches has been found to be very satisfactory. The height of the chamber is not important in itself except that it is usually preferable for the orifice of the wiping die to be approximately 2 to 10 inches above the surface of the molten coating bath and the chamber must be accomodated within this space. The chamber will preferably be cylindrical surrounding the wire or linear material passing through it. However other shapes can be used. It is generally more efficient, however, to have the circumference of the chamber at a substantially uniform distance from the linear material passing through the chamber so that the zinc powder is uniformly exhausted away from the linear material through the slots 393. If, for example, a square chamber was used, zinc powder might, unless the slots 389 were disposed in the corners, tend to accumulate in the corners and then float to the center where it can contact the wire. With the foregoing basic considerations in mind it will be seen that the exact shape and dimensions of the protective chamber will be determined principally by convenience with respect to fabrication, the space available and ease of mounting in position over the coating bath.

Figure 11:
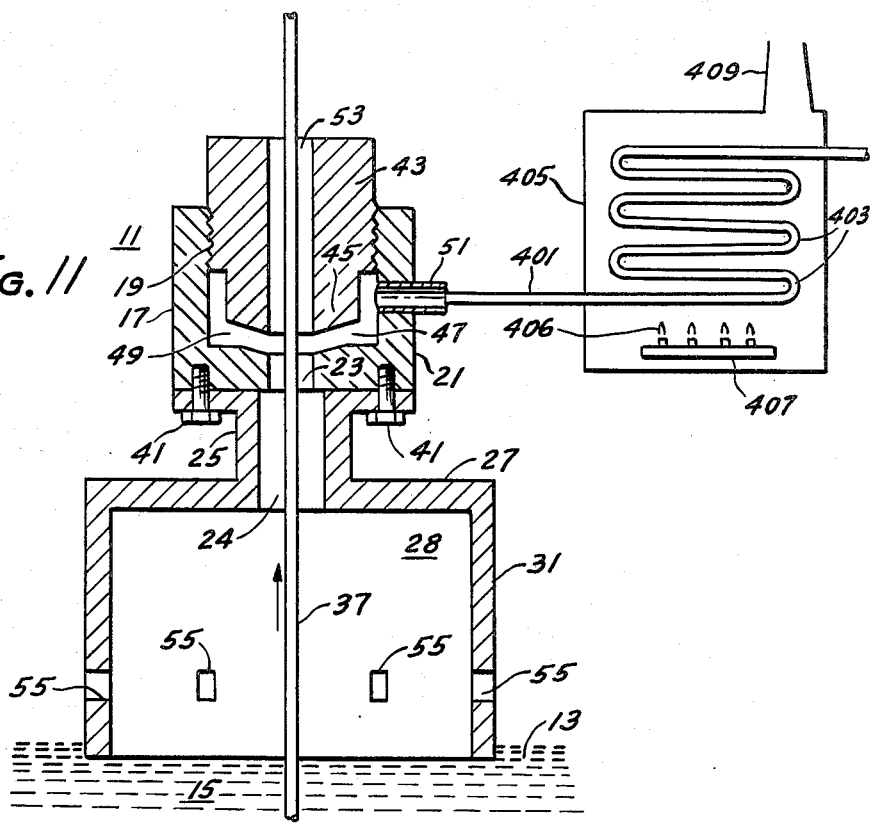
FIG. 11 shows schematically in cross section a further arrangement for eliminating precipitated zinc dust from the interior of a protective hood, in this case by the use of a heated wiping gas.

FIG. 11 shows in schematic cross section a protective hood and wiper arrangement in which the wiping gas is heated to an elevated temperature which is sufficiently high so that the entire protective chamber and protective gas within the chamber is maintained above the melting point of zinc. Zinc powder is therefore effectively prevented from forming and precipitating upon the molten bath surface. In FIG. 11 a wiping die and protective hood arrangement is shown which is substantially identical to the arrangement shown in FIG. 1 and consequently similar structures in the die and hood portion of the apparatus are identified with the same designation numerals in both FIGURES. For a description of these structures reference may be had to the description in connection with FIG. 1. In addition the gas inlet piping 401 which passes to the inlet orifice 51 is connected to a series of heat exchange coils 403 disposed in a heating means 405. Flames 406 from a burner 407 serve to heat the coils 403 as the hot gases from the flames pass upwardly through the coils 403 and out the stack 409. The coils 403 are maintained at a temperature well above the melting temperature of zinc and sufficiently elevated so that the wiping gas remains well above the melting temperature of zinc even after it has passed through the wiping orifices 49 of the wiping die 11 and expanded into the protective chamber 28. In this manner the temperature of the protective atmosphere within the protective chamber is kept at a temperature at which vaporized zinc will not solidify and no zinc powder will form, thus eliminating any powder burns or other difficulties related to the presence of zinc powder in the protective chamber. It will be understood that any other suitable means for heating the wiping gas may be substituted for the burner means 407 shown in FIG. 11. For example, the coils 403 could be heated by electrical heating elements or the like. The hood 31 is shown with orifices 55 to allow escape of the heated protective gas. The gas could, however, be allowed to exit from the top of the wiper.

Figure 12:
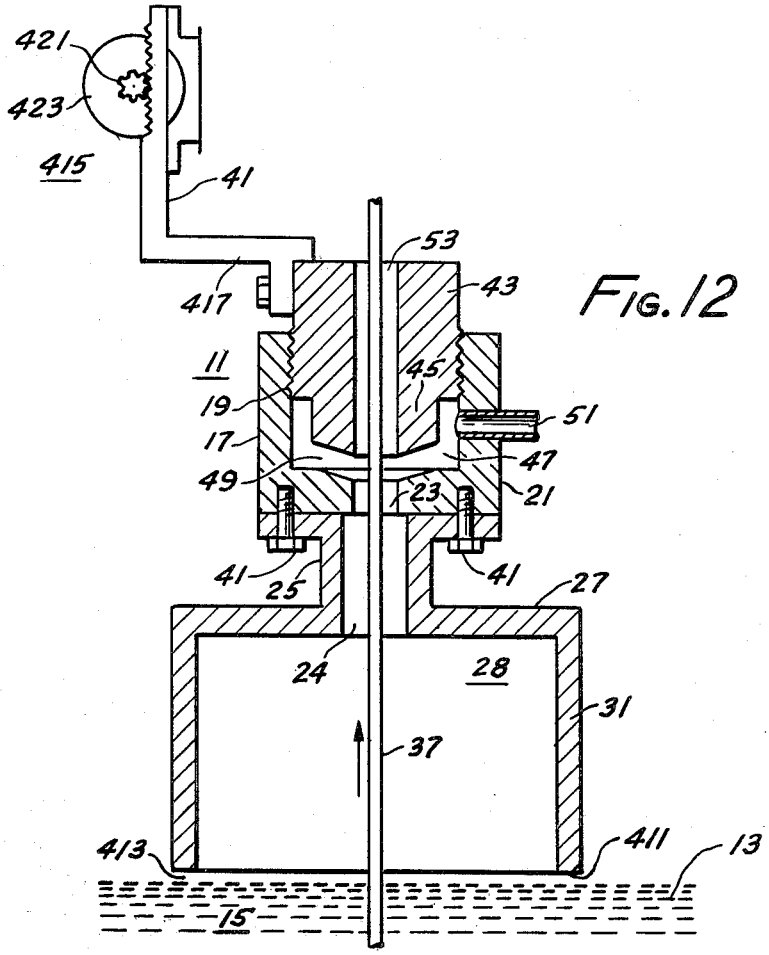
FIG. 12 shows schematically a further version of a slotted hood arrangement in which an effective slot for exhaust of zinc powder extends substantially completely about the lower portion of the hood.

FIG. 12 shows a further embodiment of the invention in which a wiping die and protective chamber combination is arranged with the protective chamber positioned with its lower edge just off the surface of the molten coating bath. In this manner an effective horizontal slot is formed all around the bottom of the protective chamber so that the passage of nonoxidizing gas from the chamber around the bottom circumference very effectively sweeps zinc powder from the surface of the molten bath in all directions. In FIG. 12 a wiping die and hood arrangement similar to that shown in FIG. 1 is shown and therefore similar structures in the die and hood portion of the apparatus have been given the same identifying numbers. For a description of these structures reference may be had to the description in connection with FIG. 1. In FIG. 12, however, instead of the protective chamber 28 having the slots 55 in its sidewalls 31, the bottoms 411 of the sidewalls 31 are maintained slightly above the surface 13 of the molten bath forming an effective horizontal, circumferential slot 413 all about the bottom of the protective chamber 28. Since the level of the molten bath may vary from time to time as molten coating metal is withdrawn on the wire 37 and as additional aluminum-zinc alloy is added to the molten bath from time to time, a means 415 for adjusting the height of the entire die and protective chamber combination is shown in FIG. 12. The adjustment means 415 comprises a bracket 417 attached to the wiping die 11 and in turn secured to an attached rack 419 and pinion 421. The pinion is secured to the shaft of an adjustment motor 423 which may be operated as necessary to vary the elevation of the apparatus above the bath. Detection of the relative position of the bath surface and the bottom of the protective chamber and initiation of adjustment may be either manual or automatic. It will be understood that various other arrangements in addition to that shown may be used to vary the relative position of the bottom of the protective chamber and the surface of the bath including means known in the art for precisely varying the level of the bath rather than the elevation of the wiping apparatus.

While, as explained above, the present inventor has invented several novel devices and methods for removing zinc dust or other metallic particulates from the vicinity of linear material issuing from an aluminum-zinc bath, it will be understood from the foregoing that the basic invention is broader than the specific novel apparatus described and claimed and comprises broadly a method for preventing or minimizing the formation of powder burns or other defects on aluminum-zinc hot dip coated linear material by restricting the presence of metallic powder formed from solidification of zinc vapor from the interior of any protective atmosphere containing hood surrounding the linear material and open to the molten bath surface in the vicinity of the emergence of the linear material from the molten bath.

It should be noted that it is the accumulation of a substantial or detrimental amount of particulate powder upon the surface of the molten bath and/or the coated product which is to be prevented. The preseuce of isolated particulates of the low melting component do not seem to do a great deal of harm. A substantial deposit, however, will cause serious problems with powder burns in an aluminum-zinc coating operations. A substantial deposit may be defined as sufficient powder so that such particles are piled one upon the other or are accumulated upon the surface of the coating with little space between individual particles. It will be evident therefore that in order to obtain the benefits of the present invention it is not necessary to absolutely prevent or eliminate the formation or accumulation of zinc powder, but merely to substantially prevent or reduce such formation or accumulation. It will be understood, therefore, that the term "preventing" refers in this context to substantial prevention, minimization and substantial reduction of zinc powder.

As stated above, the accumulation of detrimental amounts of particulates may be prevented by interfering with the natural evaporation of the vapor of the particulate from the surface of the hot coating bath by, for example, providing a cover of some sort over the surface of the molten coating bath, by preventing the deposition of already precipitated or solidified particulates upon the bath surface, for example, by use of a catcher or by exhausting the particulates from the protective enclosure, or by destroying or decomposing particulates already formed, for example, by reheating the particulates so that they melt into the bath. Alternatively the apparatus may be kept at an elevated temperature to avoid solidification and precipitation of the zinc vapor as zinc powder.

I claim:

1. An improved apparatus for wiping and protecting linear material passing from a molten metallic aluminum-zinc coating bath comprising:

(a) a gas wiping die which wipes the linear material as it passes from the molten bath with a protective non-oxidizing gas, (b) a containment means for protective gas surrounding the linear material as it leave the molten bath and positioned adjacent to the gas wiping die such that protective non-oxidizing gas is discharged from the gas wiping means into the containment means, and (c) orifice means in the containment means adjacent to the surface of the molten bath through which protective gas is discharged from the containment means carrying with it metallic zinc particles which might otherwise settle upon the surface of the molten bath within the containment means.

2. Improved apparatus according to claim 1 wherein the orifice means has a slotted shape.

3. Improved apparatus according to claim 2 wherein the lengthwise dimension of the orifice means is diposed substantially perpendicularly with respect to the surface of the coating bath.

4. Improved apparatus for wiping linear material with a wiping gas comprising:

(a) a containment means for a protective gas surrounding the linear material as it passes from a molten metal coating bath, (b) a gas wiping die surrounding said linear material and having a throat discharging into the containment means and orifice means in the containment means having an elongated slot type cross section oriented substantially perpendicularly with respect to the molten coating bath and the lower portions of which slot members are disposed adjacent the surface of the molten coating bath.

5. An improved protective hood means for protecting linear material passing from a molten aluminum-zinc coating bath comprising:

(a) a protective gas containment means for containment of a protective gas and through which the linear material passes as it leaves the molten bath, (b) means for supplying protective gas to the containment means, (c) orifice means in the walls of the containment means adjacent the surface of the molten coating bath through which excess protective gases pass from the containment means.

6. Improved apparatus for preventing precipitation of fine particles of solidified evaporated metal upon a molten metal bath surface comprising a containment means for a protective gas in contact with the surface of the molten metal bath, the horizontal dimensions of at least a portion of the containment means being such as to define an area substantially greater than the area of bath surface exposed to said protective gas, and a means for intercepting a major proportion of any metal particles which precipitate from the protective gas.

7. The improved apparatus of claim 6 wherein the containment means for the protective gas is associated with a gas wiping die which operates with the same gas.

8. An improved apparatus according to claim 6 wherein the means to intercept the particles of metal is a catcher disposed in the bottom of the protective gas containment chamber.

9. An improved apparatus according to claim 8 wherein the containment means is associated with a gas wiping means using the same protective gas.

10. A wiping apparatus for linear material issuing from a molten metal coating bath comprising:

(1) a gas wiping die disposed adjacent the surface of the linear material above the surface of the molten bath, (b) gas containment means between the die and the bath surface containing a protective gas surrounding the linear material:

(i) a closure means in the bottom of said containment means arranged and constructed to intercept a major portion of solidified evaporated metal particles which settle out of the gas within the containment means, (ii) an orifice means in the bottom of said closure means to allow passage of said linear material from the bath surface into the containment means and exposing a portion of the bath surface to the gas within the containment means, (iii) said containment means having transverse dimensions which define an area substantially greater than the area of the surface of the molten bath exposed to the interior of said containment means, (c) means to admit a protective gas to said containment means and a wiping gas to said wiping means.

11. The wiping apparatus of claim 10 wherein the interior of the wiping die and the gas containment means interconnect such that the wiping gas has access to and can flow into the interior of the containment means.

12. The wiping apparatus of claim 11 wherein the closure means is in the form of a flat tray.

13. The wiping apparatus of claim 12 wherein the closure means has an upwardly extending dam about the orifice means of (iii).

14. The wiping apparatus of claim 13 wherein the wiping die and gas containment means are adapted for the passage of linear material in the form of a wire.

* * * * *